US008191633B2

(12) United States Patent
Frazier

(10) Patent No.: US 8,191,633 B2
(45) Date of Patent: Jun. 5, 2012

(54) DEGRADABLE DOWNHOLE CHECK VALVE

(76) Inventor: W. Lynn Frazier, Corpus Christi, TX (US)

( * ) Notice: Subject to any disclaimer, the term of this patent is extended or adjusted under 35 U.S.C. 154(b) by 218 days.

(21) Appl. No.: 12/204,951

(22) Filed: Sep. 5, 2008

(65) Prior Publication Data

US 2009/0065216 A1 Mar. 12, 2009

Related U.S. Application Data

(60) Provisional application No. 60/970,823, filed on Sep. 7, 2007.

(51) Int. Cl.
*E21B 34/00* (2006.01)

(52) U.S. Cl. ..... 166/317; 166/133; 166/376

(58) Field of Classification Search ..... 166/133, 166/188, 317, 325, 373, 376, 318
See application file for complete search history.

(56) References Cited

U.S. PATENT DOCUMENTS

| | | | | | |
|---|---|---|---|---|---|
| 244,042 | A | | 7/1881 | Farrar | |
| 2,128,253 | A | * | 8/1938 | Johnson | 166/264 |
| 2,249,172 | A | * | 7/1941 | Quintrell | 166/125 |
| 2,945,678 | A | * | 7/1960 | Boudreaux et al. | 175/317 |
| 3,015,469 | A | | 1/1962 | Falk | |
| 3,148,731 | A | * | 9/1964 | Holden | 166/141 |
| 3,298,440 | A | * | 1/1967 | Current | 277/340 |
| 3,524,503 | A | * | 8/1970 | Baker | 166/289 |
| 4,218,299 | A | | 8/1980 | Lindell et al. | |
| 4,510,994 | A | | 4/1985 | Pringle | |
| 4,541,484 | A | | 9/1985 | Salerni et al. | |
| 4,553,559 | A | | 11/1985 | Short, III | |
| 4,605,074 | A | | 8/1986 | Barfield | |
| 4,739,799 | A | | 4/1988 | Carney et al. | |
| 4,813,481 | A | | 3/1989 | Sproul et al. | |
| 4,969,524 | A | | 11/1990 | Whiteley | |
| 5,012,867 | A | | 5/1991 | Kilgore | |
| 5,335,727 | A | * | 8/1994 | Cornette et al. | 166/278 |
| 5,511,617 | A | | 4/1996 | Snider et al. | |
| 5,704,393 | A | * | 1/1998 | Connell et al. | 137/614.21 |
| 5,924,696 | A | | 7/1999 | Frazier | |
| 6,065,541 | A | * | 5/2000 | Allen | 166/318 |
| 6,220,360 | B1 | * | 4/2001 | Connell et al. | 166/373 |
| 6,712,153 | B2 | * | 3/2004 | Turley et al. | 166/387 |
| 7,350,582 | B2 | * | 4/2008 | McKeachnie et al. | 166/373 |
| 2007/0051521 | A1 | * | 3/2007 | Fike et al. | 166/387 |
| 2008/0073074 | A1 | * | 3/2008 | Frazier | 166/138 |

* cited by examiner

*Primary Examiner* — David Bagnell
*Assistant Examiner* — Catherine Loikith
(74) *Attorney, Agent, or Firm* — Edmonds & Noite, PC

(57) ABSTRACT

Composite downhole tools for hydrocarbon production and methods for using same. The downhole tool can include an annular body having a valve assembly disposed therein. The valve assembly can include a first member preventing flow in a first direction through the annular body; a second member preventing flow in a second direction through the annular body; and a shoulder disposed on an inner diameter of the body between the first and second members. The shoulder can have a first end contoured to sealingly engage an outer contour of the first member and a second end contoured to sealingly engage an outer contour of the second member.

28 Claims, 7 Drawing Sheets

DEGRADABLE DOWNHOLE CHECK VALVE

CROSS-REFERENCE TO RELATED APPLICATIONS

This application claims priority to U.S. Provisional Patent Application having Ser. No. 60/970,823, filed on Sep. 7, 2007, which is incorporated by reference herein.

BACKGROUND OF THE INVENTION

1. Field of the Invention

Embodiments of the present invention generally relate to composite downhole tools for hydrocarbon production and methods for using same. More particularly, embodiments of the present invention relate to a degradable composite tool for isolating one or more hydrocarbon bearing intervals.

2. Description of the Related Art

An oil or gas well is typically a wellbore extending into a well to some depth below the surface. The wellbore may be lined with a tubular or casing to strengthen the walls of the borehole. To further strengthen the walls of the borehole, the annular area formed between the casing and the borehole is typically filled with cement.

After completion of the wellbore, the casing can be perforated to allow hydrocarbon to enter the wellbore and flow toward the surface. Fracturing is a technique used to stimulate production of hydrocarbons from the surrounding formation. Hydrocarbons are often found in multiple zones within a subterranean formation. Such multiple hydrocarbon-bearing zones can require multiple fractures to extract the hydrocarbons.

Current methods for producing hydrocarbons from multiple zones within a formation fracture the lowest zone in the well first, produce the fractured zone, and then isolate the wellbore immediately above the fractured zone so that an adjacent zone can be fractured and produced. Plugs have been used to block off the well bore above each fractured zone to prevent production from flowing down the wellbore to a previously produced zone. After perforating and fracing each individual hydrocarbon bearing zone, the plugs are removed to re-open the wellbore.

The plugs can be removed by drilling. However, a common problem with drilling plugs is that without some sort of locking mechanism, the plug components tend to rotate with the drill bit, which can result in extremely long drill-out times, excessive casing wear, or both. Long drill-out times are highly undesirable, as rig time is typically charged by the hour. Once deactivated, the drilled plug falls to the bottom of the hole. Often, a partially drilled plug falls only part way and can create an obstruction within the wellbore. These obstructions increase the differential pressure through the wellbore, thereby reducing production of the formation.

Furthermore, differential pressure across the plug can be so great that drilling becomes difficult or near impossible. Plugs with built-in check valves have been used to allow one-way flow therethrough, lowering the differential pressure across the plug. However, such valves cannot be used to prevent bi-directional flow through the wellbore. For instance, a plug may be desired to isolate a zone for pressure testing, or for some other temporary isolation need. Once the isolation need is over, re-establishing flow through the wellbore is desired. Such valves with one-way check valves are not suitable for this type of service or workover needs.

There is a need, therefore, for a downhole tool that can temporarily isolate a wellbore and re-establish flow therethrough in-situ.

SUMMARY OF THE INVENTION

Composite downhole tools for hydrocarbon production and methods for using same are provided. In at least one specific embodiment, the downhole tool can include an annular body having a valve assembly disposed therein. The valve assembly can include a first member preventing flow in a first direction through the annular body; a second member preventing flow in a second direction through the annular body; and a shoulder disposed on an inner diameter of the body between the first and second members. The shoulder can have a first end contoured to sealingly engage an outer contour of the first member and a second end contour to sealingly engage an outer contour of the second member.

In at least one other specific embodiment, the downhole tool can include an annular body having a valve assembly disposed therein. The valve assembly can include a first member preventing flow in a first direction through the annular body; a second member preventing flow in a second direction through the annular body; and a shoulder disposed in an inner diameter of the body. The shoulder can have a first end for engaging the first member and a second end for engaging the second member. The downhole tool can also include an element system disposed about the annular body; a first and second back-up ring each having two or more tapered wedges; wherein the tapered wedges are at least partially separated by two or more converging grooves; and a first and second cone disposed adjacent the first and second back-up rings.

In at least one specific embodiment, the method can include isolating the wellbore with a tool comprising an annular body having a valve assembly disposed therein, wherein the valve assembly comprises: a degradable member preventing flow through the annular body; a non-degradable member preventing flow through the annular body; and a shoulder disposed on an inner diameter of the body between the members. The shoulder can have a first end contoured to sealingly engage an outer contour of the degradable member and a second end contoured to sealingly engage an outer contour of the non-degradable member. The tool can be exposed to a temperature or pressure sufficient to decompose the degradable member over a pre-determined period of time.

In at least one other specific embodiment, the method can include isolating the wellbore with a tool comprising an annular body having a valve assembly disposed therein, wherein the valve assembly comprises: a degradable member preventing flow through the annular body; a non-degradable member preventing flow through the annular body; and a shoulder disposed on an inner diameter of the body between the members, the shoulder having a first end contoured to sealingly engage an outer contour of the degradable member and a second end contoured to sealingly engage an outer contour of the non-degradable member. The tool can be exposed to a temperature or pressure sufficient to decompose the degradable member over a pre-determined period of time, wherein the decomposed degradable member releases differential pressure within the tool. A hydrocarbon-bearing zone can be pressure tested during the pre-determined period of time, and the tool can be drilled up after the pressure testing is completed and the differential pressure is released.

BRIEF DESCRIPTION OF THE DRAWINGS

So that the manner in which the above recited features of the present invention can be understood in detail, a more particular description of the invention, briefly summarized above, can be had by reference to embodiments, some of which are illustrated in the appended drawings. It is to be noted, however, that the appended drawings illustrate only typical embodiments of this invention and are therefore not to be considered limiting of its scope, for the invention can admit to other equally effective embodiments.

DETAILED DESCRIPTION OF THE PREFERRED EMBODIMENT

A detailed description will now be provided. Each of the appended claims defines a separate invention, which for infringement purposes is recognized as including equivalents to the various elements or limitations specified in the claims. Depending on the context, all references below to the "invention" can in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

The terms "up" and "down"; "upper" and "lower"; "upwardly" and "downwardly"; "upstream" and "downstream"; "above" and "below"; and other like terms as used herein refer to relative positions to one another and are not intended to denote a particular direction or spatial orientation.

Figure 1A:
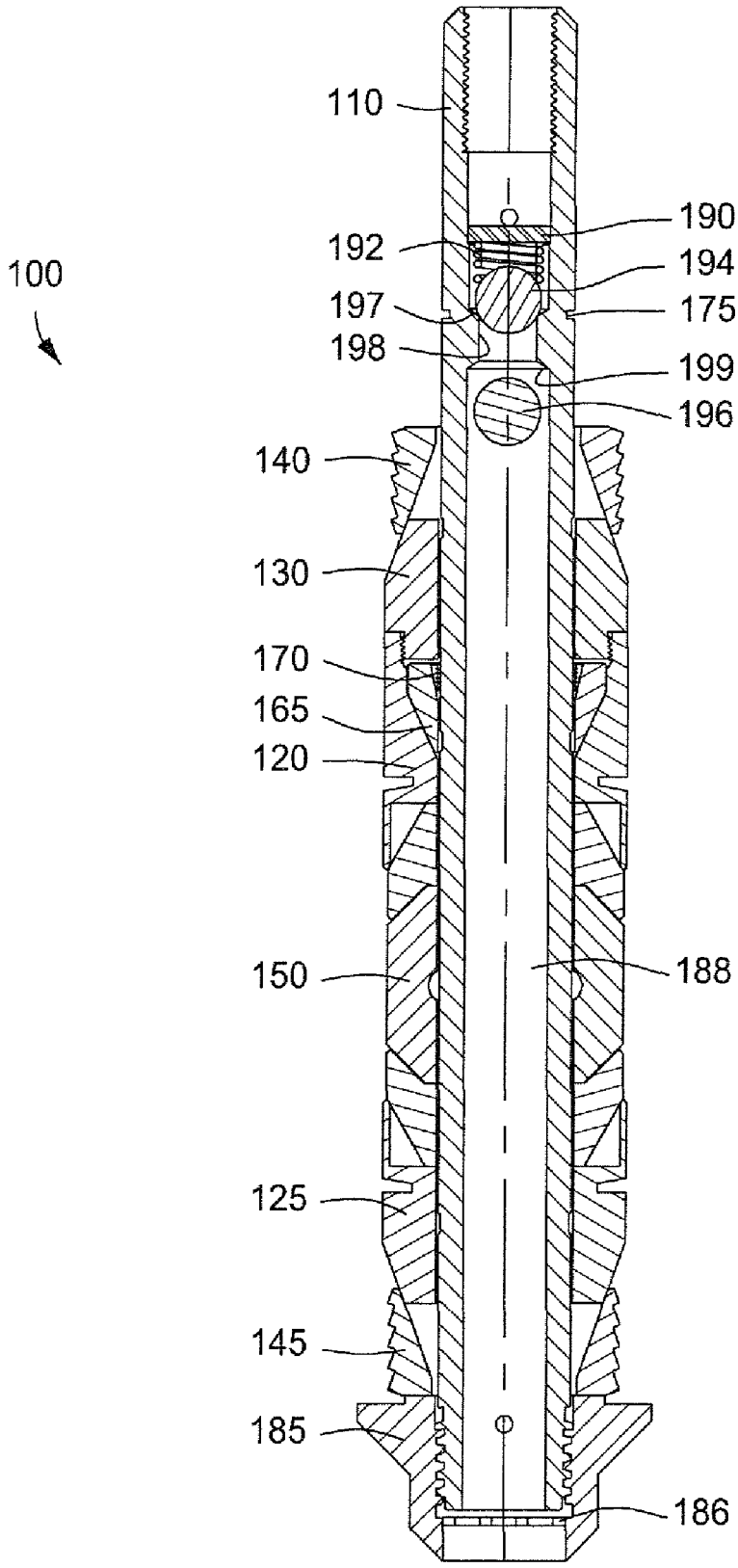
FIG. 1A depicts a sectional view of an illustrative tool according to one or more embodiments described.
Figure 1B:
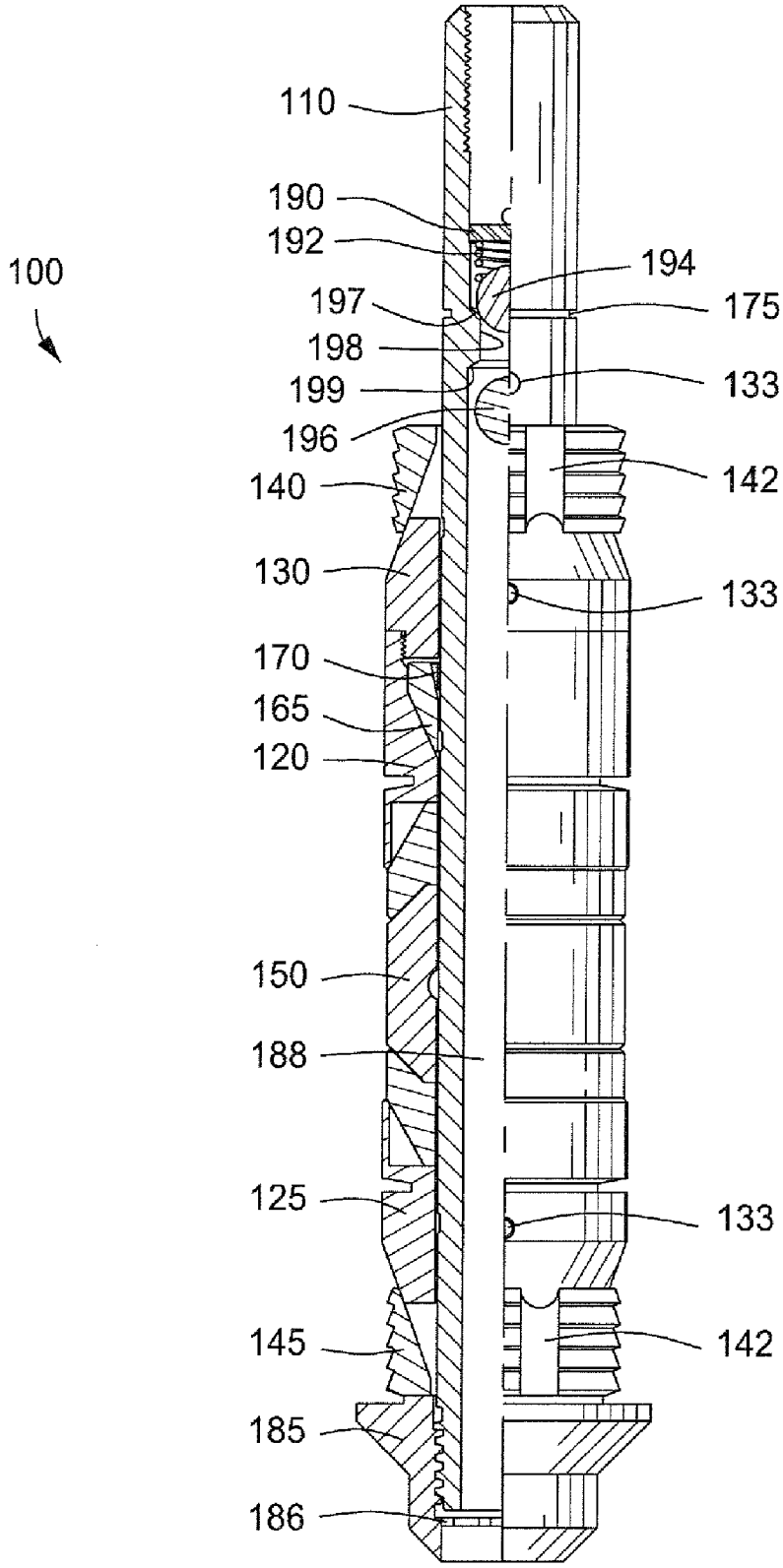
FIG. 1B depicts a partial sectional view of the tool depicted in FIG. 1A.
Figure 1D:
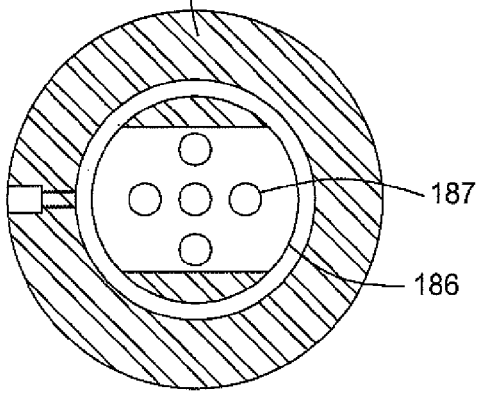
FIG. 1D depicts an illustrative perforated member, according to one or more embodiments described.
Figure 1C:
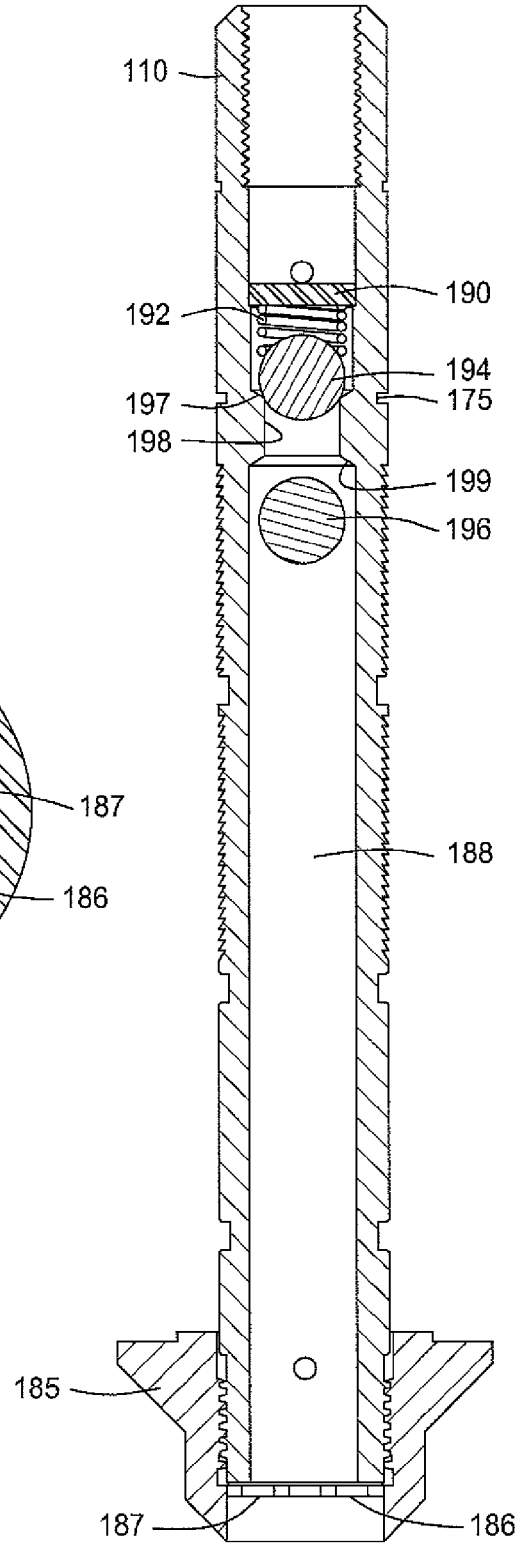
FIG. 1C depicts a sectional view of a body of the tool depicted in FIG. 1A.

FIG. 1A depicts a sectional view of an illustrative tool according to one or more embodiments described, FIG. 1B depicts a partial sectional view, and FIG. 1C depicts a view of a body as depicted in FIGS. 1A and 1B. The tool 100 can include a body ("body") 110, first back-up ring 120, second back-up ring 125, first slips 140, second slip 145, element system 150, lock ring 170, sub assembly 185, and valve assembly. In one or more embodiments, the body 110 can be hollow, i.e. annular, defining a flow path therethrough. Each of the rings 120, 125, 170; slips 140, 145; elements 150; and sub assembly 185 are disposed about the body 110. One or more of the rings 120, 125, 170; slips 140, 145; elements 150; and sub assembly 185 can be constructed of a non-metallic material, preferably a composite material, and more preferably a composite material described herein. In one or more embodiments, each of the rings 120, 125, 170; slips 140, 145; elements 150; and sub assembly 185 can be constructed of a non-metallic material. The non-metallic material can be a composite material, such as a composite material described herein.

In one or more embodiments, the valve assembly can be disposed within an upper portion of the body 110. The valve assembly can include one or more spring retainers 190, springs 192, first members 194, second members 196, and shoulders 198. In one or more embodiments, the first member 194 can prevent fluid communication through the tool 100 in a first direction. The second member 196 can prevent fluid flow through the tool 100 in a second direction. The first and second members 196 and 198 can be disposed within the body 110 on opposite ends of the shoulder 198. The shoulder 198 can have a reduced cross section located about a portion of the body 110. The shoulder 198 can be a narrowed section or portion (i.e. "throat") of the body 110. In one or more embodiments, the shoulder 198 can be a separate component attached to or otherwise disposed on the inner diameter of the body 110.

The first member 194 can be adapted to seat or otherwise rest on a first end 197 of the shoulder 198. The first end 197 of the shoulder 198 can be beveled, chamfered, or otherwise contoured to correspond to the outer contour of the first member 194. The first member 194 can have any external contour that can provide a fluid tight seal with the first end 197 of the shoulder 198. For example, the first member 194 can be spherical, squared, or conical. In one or more embodiments, the first member 194 can be a ball.

When seated, fluid flow across the first member 194 can be prevented. Longitudinal movement of the first member 194 within the body 110 can be regulated with the spring 192 and spring retainer 190. The spring retainer 190 can have an annular member having a flow path therethrough. The spring retainer 190 can be disposed within an inner diameter of the body 110, and adapted to hold the spring 192. Although not shown, the spring retainer 190 can be a split ring, e.g. "C" ring that can engage the inner diameter of the body 110 and held in place via a friction fit. In one or more embodiments, spring retainer 190 can be a split ring and the inner diameter of the body 110 can have a recessed groove adapted to receive and hold the spring retainer 190. In one or more embodiments, the spring retainer 190 can have external threads to matingly engage corresponding grooves disposed on the inner diameter of the body 110.

The spring 192 contacts the first member 194 and is adapted to urge the first member 194 against the shoulder 198. The spring 192 can be a helical compression member. In one or more embodiments, the spring 192 can be a helical compression member having a pre-determined compression point or loading to adjust or regulate differential pressure required to lift and/or separate the first member 196 from the shoulder 198, which can allow flow across the shoulder 198. The pre-determined compression of the spring 192 can also dictate the amount of downhole pressure against which the tool 100 must be drilled in order to remove the tool 100 from the wellbore.

In one or more embodiments, the pre-determined compression of the spring 192 can be sufficient to hold differential pressures up to 15,000 psig. In one or more embodiments, the pre-determined compression of the spring 192 can be sufficient to hold differential pressures up to 10,000 psig. In one or more embodiments, the differential pressure can range from a low of about 10 psig, 50 psig, or 100 psig to a high about 1,000 psig, 2,000 psig, or 5,000 psig. For example, the pressure can range from 10 psig to 5,000 psig, 10 psig to 3,000 psig, 10 psig to 1500 psig, 10 psig to 100 psig, 10 psig to 90 psig, 25 psig to 5000 psig, 15 psig to 5,000 psig, 15 psig to 3,000 psig, 15 psig to 1500 psig, 25 psig to 100 psig, 25 psig to 90 psig, and from 100 psig to 5000 psig.

The second member 196 can be disposed on an opposite end of the shoulder 198. The second member 196 can be adapted to seat or otherwise rest on a second end 199 of the shoulder 198. Like the first member 194, the second member 196 can have any external contour that can provide a fluid tight seal with the second end 199. The second end 199 can be beveled, chamfered, or otherwise contoured to correspond to the outer contour of the second member 196. In one or more embodiments, the second member 196 is spherical, squared, or conical. In one or more embodiments, the second member 196 can be a ball. Fluid flow across the second member 196 is prevented when the second member 196 is seated against the second end 199.

FIG. 1C depicts a view of the body 110, sub assembly 185, and perforated member or plate 186. FIG. 1D depicts another view of the perforated member 186, according to one or more embodiments. The perforated member 186 can be disposed at one end of the body 110, opposite the valve assembly. The shoulder 198 and the perforated member 186 can define or provide a cavity or void 188 therebetween. The second member 196 can be disposed within cavity 188, and can move freely within the body 110 between the shoulder 198 and the plate 186.

The perforated member 186 can be a flat plate or disk. The perforated member 186 can be disposed anywhere along a longitudinal axis of the body 110. In one or more embodiments, the perforated member 186 can be disposed within the sub-assembly 185 attached or otherwise disposed on the end of the body 110, as shown in FIG. 1C. In one or more embodiments, the perforated member 186 can be disposed between the end of the body 110 and the sub-assembly 185. In one or more embodiments, the perforated member 186 can be disposed within the inner diameter of the body 110.

The perforated member 186 can include one or more opening or apertures 187 formed therethrough. Each aperture 187 forms a flow path in communication with the body 110. As fluid enters the body 110 via the apertures 187 in the perforated member 186, the fluid can lift or otherwise push the second member 196 within the cavity 188 toward the shoulder 198. With sufficient fluid pressure, the fluid pressure can seat the second member 196 on the second end 199 of the shoulder 198, preventing fluid flow thereacross.

In one or more embodiments, either the first member 194 or the second member 196 is fabricated from a degradable material. Any suitable degradable material can be used. The degradable material can be organic or inorganic. Preferably, the material has a specific gravity greater than 1.0, such as greater than 1.1, 1.2, or 1.5. Specific examples include collagen, hydrocarbon resin, wax, silicon, silicone, polymers, rubber, and elastomer.

In one or more embodiments, the degradable material decomposes at a pre-determined rate based on temperature, pressure, and/or pH. As such, fluid flow can be prevented for a predetermined period of time through the tool 100 until the degradable member 194 or 196 decomposes, which allows flow in at least one direction therethrough. In one or more embodiments, the pre-determined period of time is sufficient to pressure test one or more hydrocarbon-bearing zones. In one or more embodiments, the pre-determined period of time is sufficient to workover the well. The pre-determined period of time can range from minutes to days. For example, the degradable rate of the material can range from about 5 minutes, 30 minutes, or 3 hours to about 10 hours, 24 hours or 36 hours. Extended periods of time are also contemplated.

Suitable pressures can range from 100 psig to about 15,000 psig. In one or more embodiments, the pressure can range from a low of about 100 psig, 1000 psig, or 5000 psig to a high about 1,000 psig, 7,500 psig, or about 15,000 psig.

Suitable temperatures can range from about 100° F. to about 450° F. In one or more embodiments, the temperature can range from a low of about 100° F., 150° F., or 200° F. to a high of about 350° F., 400° F., or 450° F.

In one or more embodiments, both the first member 194 and the second member 196 can be fabricated from a degradable material. In one or more embodiments, the members 194 and 196 can decompose at the same rate. In one or more embodiments, the members 194 and 196 can decompose at different rates depending on the desired direction of flow through the tool 100.

Figure 2:
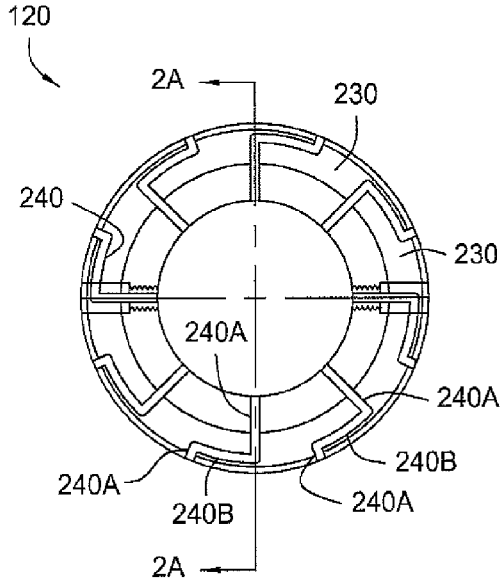
FIG. 2 depicts a plan view of an illustrative back-up ring according to one or more embodiments described.
Figure 2A:
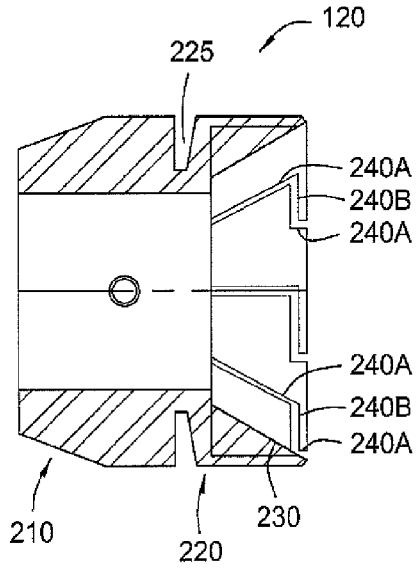
FIG. 2A depicts a cross sectional view of the back-up ring shown in FIG. 2 along lines 2A-2A.

FIG. 2 depicts a plan view of an illustrative back-up ring according to one or more embodiments described, and FIG. 2A depicts a cross sectional view of the back-up ring along lines 2A-2A. Referring to FIGS. 2 and 2A, the back-up rings 120 and 125 can be and are preferably constructed of one or more non-metallic materials. In one or more embodiments, the back-up rings 120 and 125 can be one or more annular members having a first section 210 of a first diameter that steps up to a second section 220 of a second diameter. A recessed groove or void 225 can be disposed or defined between the first and second sections 210. As will be explained in more detail below, the groove or void 225 allows the back-up ring 120 and 125 to expand.

The first section 210 can have a sloped or tapered outer surface as shown. In one or more embodiments, the first section 210 can be a separate ring or component that is connected to the second section 220, as is the first back-up ring 120 depicted in FIG. 1. In one or more embodiments, the first and second sections 210 and 220 can be constructed from a single component, as is the second back-up ring 125 depicted in FIGS. 1A and 1B. If the first and second sections 210 and 220 are separate components, the first section 210 can be threadably connected to the second section 220. As such, the two components (first and second sections 210 and 220) can be threadably engaged.

In one or more embodiments, the back-up rings 120 and 125 can include two or more tapered pedals or wedges 230 (eight are shown in this illustration). The tapered wedges 230 are at least partially separated by two or more converging grooves or cuts 240. The grooves 240 are preferably located in the second section 220 to create the wedges 230 there-between. The number of grooves 240 can be determined by the size of the annulus to be sealed and the forces exerted on the back-up ring 120 and 125.

Figure 3:
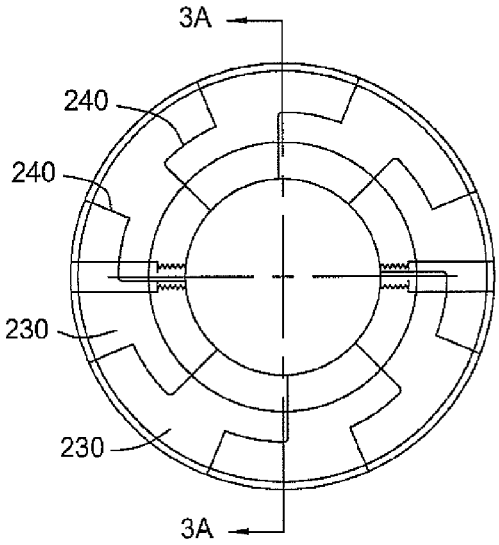
FIG. 3 depicts a plan view of the back-up ring of FIG. 2 in an expanded or actuated position.

Considering the grooves 240 in more detail, the grooves 240 can each include at least one radial cut or groove 240A and at least one circumferential cut or groove 240B. By "radial" it is meant that the cut or groove traverses a path similar to a radius of a circle. In one or more embodiments, the grooves 240 can each include at least two radial grooves 240A and at least one circumferential groove 240B disposed therebetween, as shown in FIGS. 2 and 3. As shown, the circumferential groove 240B intersects or otherwise connects with both of the two radial grooves 240A located at opposite ends thereof.

In one or more embodiments, the intersection of the radial grooves 240A and circumferential grooves 240B form an angle of from about 30 degrees to about 150 degrees. In one or more embodiments, the intersection of the radial grooves 240A and circumferential grooves 240B form an angle of from about 50 degrees to about 130 degrees. In one or more embodiments, the intersection of the radial grooves 240A and circumferential grooves 240B form an angle from about 70 degrees to about 110 degrees. In one or more embodiments, the intersection of the radial grooves 240A and circumferential grooves 240B form an angle of from about 80 degrees to about 100 degrees. In one or more embodiments, the intersection of the radial grooves 240A and circumferential grooves 240B form an angle of about 90 degrees.

In one or more embodiments, the one or more wedges 230 of the back-up ring 120 and 125 are angled or tapered from the central bore therethrough toward the outer diameter thereof, i.e. the wedges 230 are angled outwardly from a center line or axis of the back-up rings 120 and 125. Preferably the tapered angle ranges from about 10 degrees to about 30 degrees.

As will be explained below in more detail, the wedges 230 are adapted to hinge or pivot radially outward and/or hinge or pivot circumferentially. The groove or void 225 is preferred to facilitate such movement. The wedges 230 pivot, rotate or otherwise extend radially outward to contact an inner diameter of the surrounding tubular or borehole (not shown). The radial extension increases the outer diameter of the back-up rings 120 and 125 to engage the surrounding tubular or borehole, and provides an increased surface area to contact the surrounding tubular or borehole. Therefore, a greater amount of frictional force can be generated against the surrounding tubular or borehole, providing a better seal therebetween.

In one or more embodiments, the wedges 230 are adapted to extend and/or expand circumferentially as the one or more back-up rings 120 and 125 are compressed and expanded. The circumferential movement of the wedges 230 provides a sealed containment of the element system 150 therebetween. The angle of taper and the orientation of the grooves 240 maintain the back-up rings 120 and 125 as a solid structure. For example, the grooves 240 can be milled, grooved, sliced or otherwise cut at an angle relative to both the horizontal and vertical axes of the back-up rings 120 and 135 so that the wedges 230 expand or blossom, remaining at least partially connected and maintain a solid shape against the element system 150 (i.e. provide confinement). Accordingly, the element system 150 is restrained and/or contained by the back-up rings 120 and 125 and not able to leak or otherwise traverse the back-up rings 120 and 125.

Figure 3A:
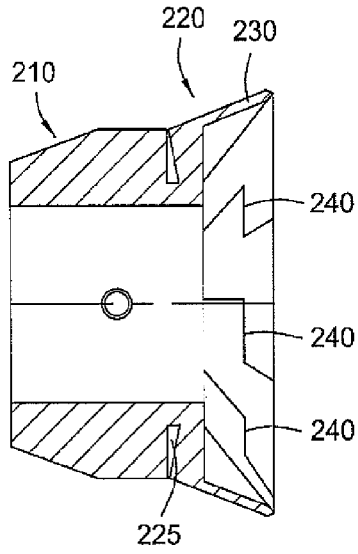
FIG. 3A depicts a cross sectional view of the actuated back-up ring shown in FIG. 3 along lines 3A-3A.

FIG. 3 depicts a plan view of the back-up ring of FIG. 2 in an expanded or actuated position, and FIG. 3A depicts a cross sectional view of the back-up ring along lines 3A-3A. Referring to FIGS. 3 and 3A, the wedges 230 are adapted to pivot or otherwise move axially within the void 225, thereby hinging the wedges 230 radially and increasing the outer diameter of the back-up rings 120 and 125. The wedges 230 are also adapted to rotate or otherwise move radially relative to one another. Such movement can be seen in this view, depicted by the narrowed space within the grooves 240.

As mentioned above, the back-up rings 120 and 125 can be one or more separate components. In one or more embodiments, at least one end of the back-up rings 120 and 125 is conical shaped or otherwise sloped to provide a tapered surface thereon. In one or more embodiments, the tapered portion of the ring members 120 and 125 can be a separate cone or tapered member 130, as depicted in FIGS. 1A and 1B. The cone 130 can be secured to the body 110 by a plurality of shearable members, such as screws or pins (not shown) disposed through one or more receptacles 133.

In one or more embodiments, the cone or tapered member 130 includes a sloped surface adapted to rest underneath a complimentary sloped inner surface of the slip members 140 and 145. As will be explained in more detail below, the slip members 140 and 145 can travel about the surface of the cone 130 or sloped section of the back-up ring member 125, thereby expanding radially outward from the body 110 to engage the inner surface of the surrounding tubular or borehole.

Each slip members 140 and 145 can include a tapered inner surface conforming to the first end of the cone 130 or sloped section of the back-up ring member 125. An outer surface of the slip members 140 and 145 can include at least one outwardly extending serration or edged tooth, to engage an inner surface of a surrounding tubular (not shown) if the slip members 140 and 145 move radially outward from the body 110 due to the axial movement across the cone 130 or sloped section of the back-up ring member 125.

The slip members 140 and 145 can be designed to fracture with radial stress. In one or more embodiments, the slip members 140 and 145 can include at least one recessed groove 142 milled therein to fracture under stress allowing the slip members 140 and 145 to expand outwards to engage an inner surface of the surrounding tubular or borehole. For example, the slip members 140 and 145 can include two or more, preferably four, sloped segments separated by equally spaced recessed grooves 142 to contact the surrounding tubular or borehole, which become evenly distributed about the outer surface of the body 110.

The element system 150 can be one or more separate components. Three components are shown in FIGS. 1A and 1B. The element system 150 can be constructed of any one or more malleable materials capable of expanding and sealing an annulus within the wellbore. The element system 150 can be constructed of one or more synthetic materials capable of withstanding high temperatures and pressures. For example, the element system 150 can be constructed of a material capable of withstanding temperatures up to 450.degree. F., and pressure differentials up to 15,000 psi. Illustrative materials can include elastomers, rubbers, Teflon®, blend, or combinations thereof.

In one or more embodiments, the element system 150 can have any number of configurations to effectively seal the annulus. For example, the element system 150 can include one or more grooves, ridges, indentations, or protrusions designed to allow the element system 150 to conform to variations in the shape of the interior of a surrounding tubular (not shown) or borehole.

Figure 4:
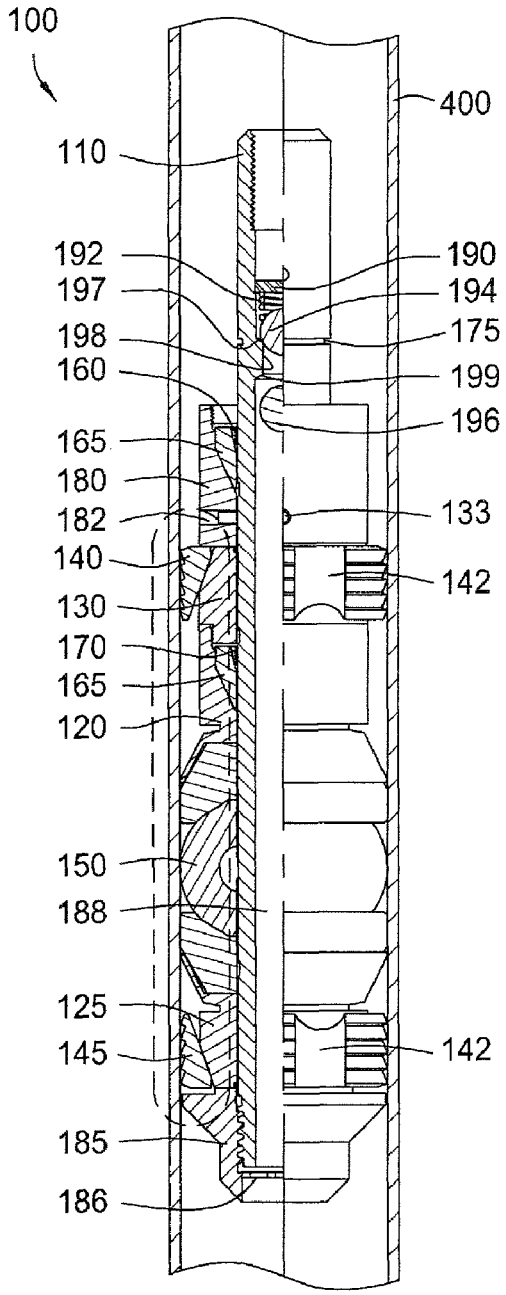
FIG. 4 depicts a partial section view of the tool located in an expanded or actuated position within a wellbore, according to one or more embodiments described.

FIG. 4 depicts a partial section view of the tool 100 located in an expanded or actuated position within a wellbore, according to one or more embodiments described. The wellbore is depicted as having a casing 400. A support ring 180 can be disposed about the body 110 adjacent a first end of the slip 140. The support ring 180 can be an annular member, and can have a first end that is substantially flat. The first end can act as a shoulder adapted to abut a setting tool, not shown but, described in detail below. The support ring 180 can include a second end adapted to abut the slip 140 and transmit axial forces therethrough. A plurality of pins can be inserted through receptacles 182 to secure the support ring 180 to the body 110.

In one or more embodiments, a lock ring 160 can be disposed about the body 110 and within an inner diameter of the support ring 180. The lock rings 160 and 170 can be split or "C" shaped allowing axial forces to compress the lock rings 160 and 170 against the outer diameter of the body 110 and hold the lock rings 160 and 170 and surrounding components in place. In one or more embodiments, the lock rings 160 and 170 can include one or more serrated members or teeth that are adapted to engage the outer diameter of the body 110. The lock rings 160 and 170 can be constructed of a harder material relative to that of the body 110 so that the lock rings 160 and 170 can bite into the outer diameter of the body 110. For example, the lock rings 160 and 170 can be made of steel and the body 110 made of aluminum.

In one or more embodiments, one or more of the lock rings 160 and 170 can be disposed within a lock ring housing 165. In one or more embodiments, the lock ring housing 165 can have a conical or tapered inner diameter that complements a tapered angle on the outer diameter of the lock rings 160 and 170. Accordingly, axial forces in conjunction with the tapered outer diameter of the lock ring housing 165 urge the lock rings 160 and 170 towards the body 110.

The body 110 can include one or more shear points 175 disposed thereon. The shear point 175 can be a designed weakness located within the body 110, and can be located near an upper portion of the body 110. In one or more embodiments, the shear point 175 can be a portion of the body 110 having a reduced wall thickness, creating a weak or fracture point therein. In one or more embodiments, the shear point 175 can be a portion of the body 110 constructed of a weaker material. The shear point 175 can be designed to withstand a pre-determined stress and is breakable by pulling and/or rotating the body 110 in excess of that stress.

In one or more embodiments, the tool 100 can be a single assembly (i.e. one tool or plug), as depicted in FIGS. 1-4 or two or more assemblies (i.e. two or more tools or plugs) disposed within a work string or otherwise connected thereto that is run into a wellbore on a wireline, slickline, production tubing, coiled tubing, or any technique known or yet to be discovered in the art.

The tool 100 can be installed in a vertical or horizontal wellbore. The tool 100 can be installed with a non-rigid system, such as an electric wireline or coiled tubing. Any commercial setting tool adapted to engage the upper end of the tool 100 can be used to activate the tool 100 within the wellbore. Specifically, an outer movable portion of the setting tool can be disposed about the outer diameter of the support ring 180. An inner portion of the setting tool can be fastened about the outer diameter of the body 110. The setting tool and tool 100 are then run into the wellbore to the desired depth where the tool 100 can be installed, for example as shown in FIG. 4.

To set or activate the tool 100, the body 10 can be held by the wireline, through the inner portion of the setting tool, while an axial force can be applied through a setting tool (not shown) to the support ring 180. The axial forces will cause the outer portions of the tool 100 to move axially relative to the body 110.

Figure 5:
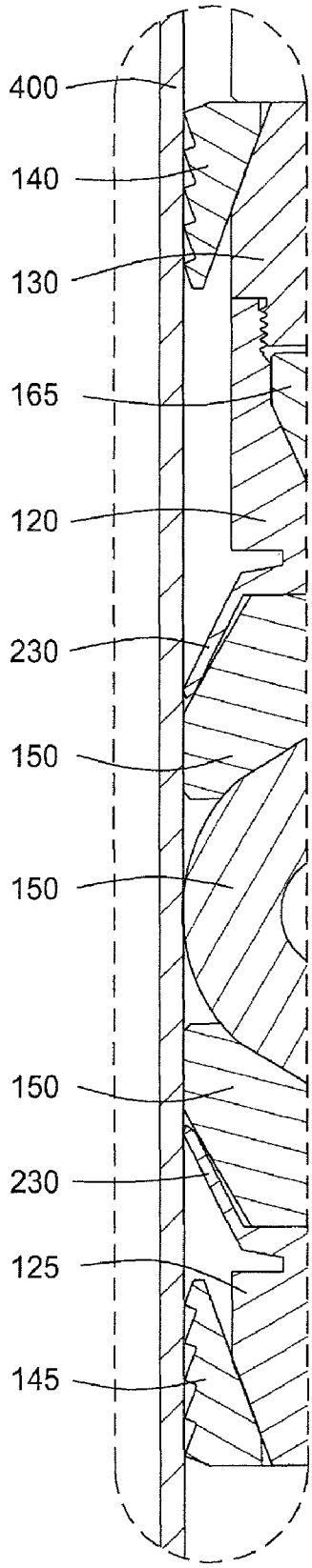
FIG. 5 depicts a partial section view of the expanded tool depicted in FIG. 4, according to one or more embodiments described.

FIG. 5 depicts a partial section view of the expanded tool depicted in FIG. 4, according to one or more embodiments described. As shown, downward axial force asserted against the support ring 180 and the upward axial force on the body 110 translates the forces to the slip members 140 and 145 and back-up rings 120 and 125. The slip members 140 and 145 move up and across the tapered surfaces of the back-up rings 120 and 125 or separate cone 130 and contact an inner surface of the casing 400. The axial and radial forces applied to the slip members 140 and 145 causes the recessed grooves 142 to fracture into equal segments, permitting the serrations or teeth of the slip members 140 and 145 to firmly engage the inner surface of the casing 400.

Figure 6:
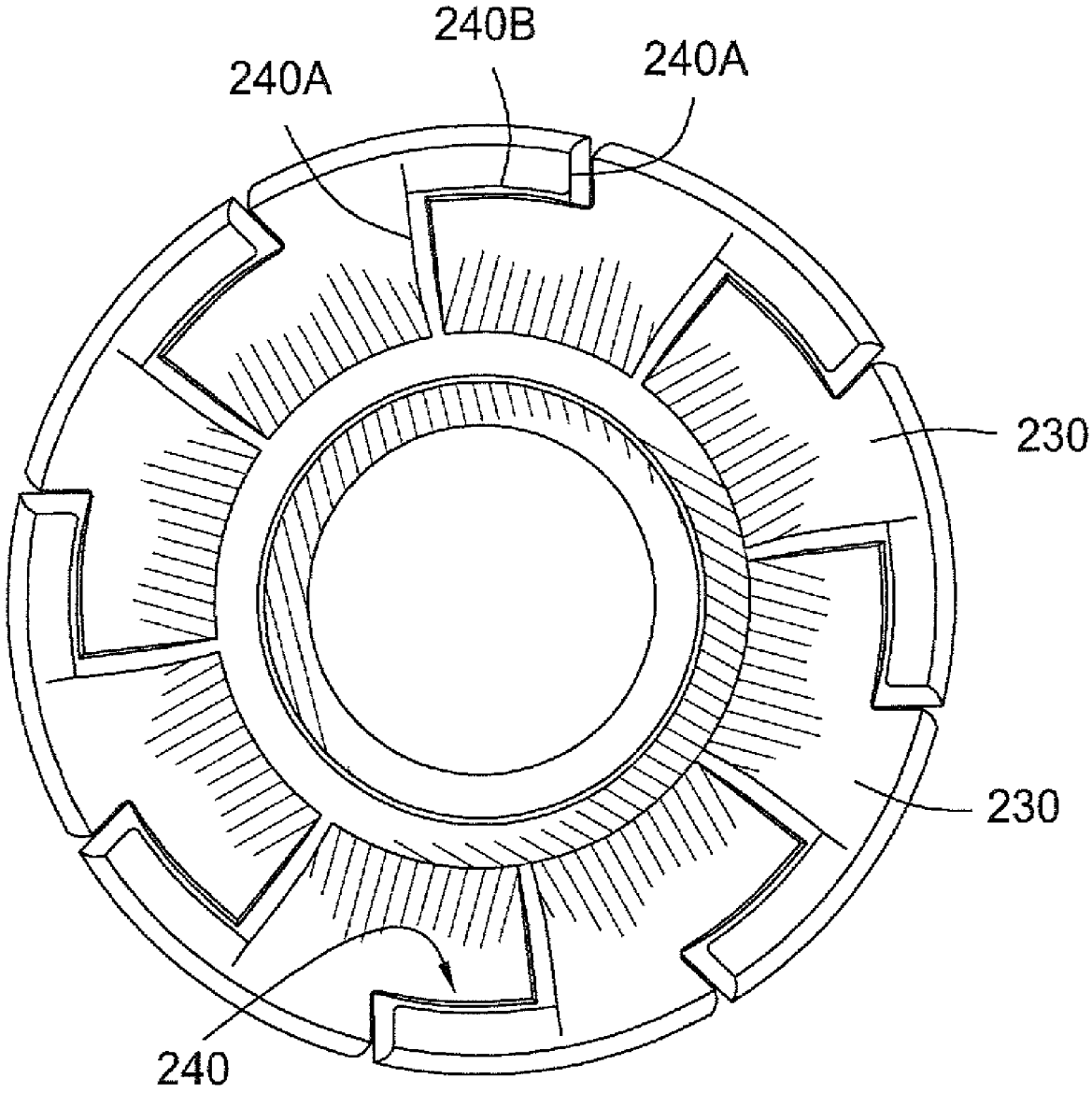
FIG. 6 depicts an illustrative isometric of the back-up ring depicted in FIG. 2 in an expanded or actuated position.

The opposing forces further cause the back-up rings 120 and 125 to move across the tapered sections of the element system 150. As the back-up rings 120 and 125 move axially, the element system 150 expands radially from the body 110 while the wedges 230 hinge radially outward to engage the casing 400. The compressive forces cause the wedges 230 to pivot and/or rotate to fill any gaps or voids therebetween and the element system 150 can be compressed and expanded radially to seal the annulus formed between the body 10 and the casing 400. FIG. 6 depicts an illustrative isometric of the back-up ring s 120 and 125 in an expanded or actuated position.

Referring again to FIGS. 4 and 5, the axial movement of the components about the body 110 can apply a collapse load on the lock rings 160 and 170. The harder lock rings 160 and 170 bite into the softer body 110 and help prevent slippage of the element system 150 once activated. Once activated, the shear point 175 is located above or outside of the components about the body 110. Accordingly, the body 110 can be broken or sheared at the shear point 175 while the activated tool 100 remains in place within the casing 400.

As mentioned, any of the components disposed about the body 110 and the body 110, can be constructed of one or more non-metallic or composite materials. In one or more embodiments, the non-metallic or composite materials can be one or more fiber reinforced polymer composites. For example, the polymeric composites can include one or more epoxies, polyurethanes, phenolics, blends thereof and derivatives thereof. Suitable fibers include but are not limited to glass, carbon, and aramids.

In one or more embodiments, the fiber can be wet wound. A post cure process can be used to achieve greater strength of the material. For example, the post cure process can be a two stage cure including a gel period and a cross linking period using an anhydride hardener, as is commonly known in the art. Heat can be added during the curing process to provide the appropriate reaction energy which drives the cross-linking of the matrix to completion. The composite material can also be exposed to ultraviolet light or a high-intensity electron beam to provide the reaction energy to cure the composite material.

Figure 7:
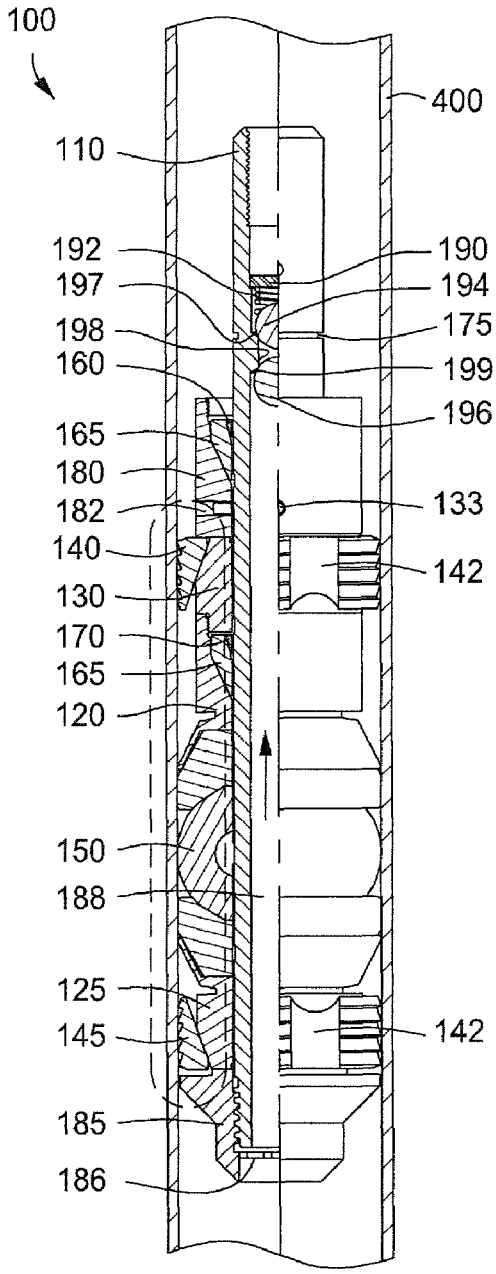
FIG. 7 depicts a partial section view of the expanded tool adapted to isolate the wellbore and prevent flow bi-directionally therethrough.

FIG. 7 depicts a partial section view of the expanded tool 100 adapted to isolate the wellbore and prevent flow bi-directionally therethrough. As depicted, the first member 194 can be seated against the first end 197 of the shoulder 198, which can prevent flow across the shoulder 198 in a first direction. The second member 196 can be seated against the second end 199 of the shoulder 198, which can prevent flow across the shoulder 198 in a second direction. As such, the flow through the tool 100 is completely shut off.

Figure 8:
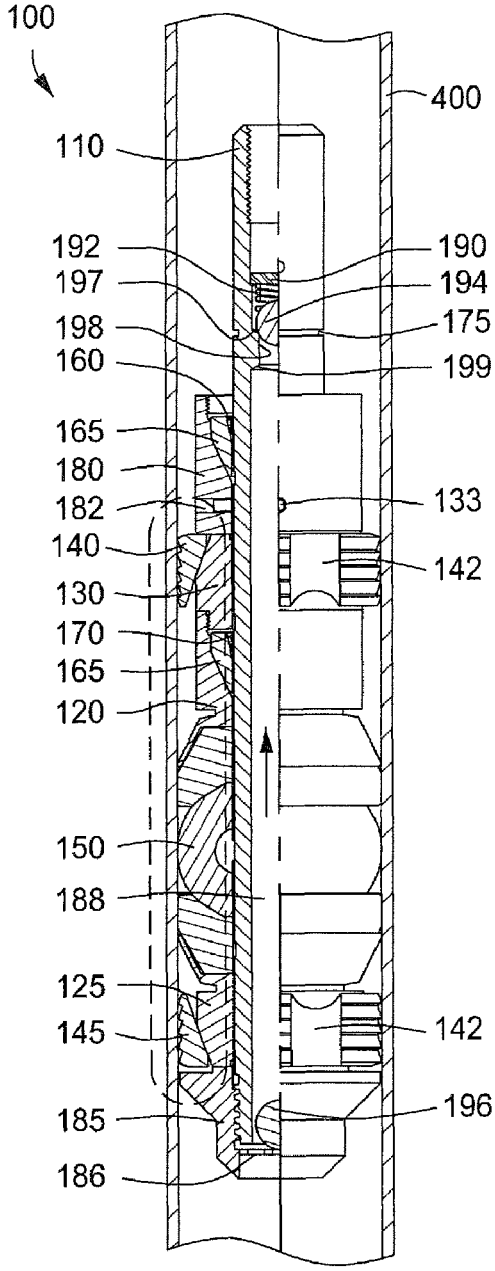
FIG. 8 depicts a partial section view of the expanded tool adapted to allow one-way flow through the wellbore.

FIG. 8 depicts a partial section view of the expanded tool after the second member is degraded, allowing fluid flow through the tool 100. The first member 194 can be lifted off the first end 197 of the shoulder 198, which can allow fluid to flow in the second direction through the tool 100, and releasing the pressure across the shoulder 198.

In operation, the tool 100 can be located within the wellbore at a pre-determined location, such as an elevation adjacent a hydrocarbon-bearing zone to be fractured. Fluid pressure against the tool 100 can seat the first member 194 against the first end 197 if asserted in a first direction, and the second member 196 can seat against the second end 199 the pressure is asserted in a second direction. This arrangement can prevent flow through the body 110. Fluid flow through the tool 100 can be prevented until the fist degradable member 194, the second degradable member 196, or a combination thereof decompose and release from the shoulder 198. If the first member 194 is degradable, fluid can flow in the first direction through the body 100. If the second member 196 is degradable, fluid can flow in the second direction through the body 100.

In at least one specific embodiment, two tools 100 can each having a degradable second member 196. The two tools 100 can be located on opposite ends of a hydrocarbon-bearing zone. The tools 100 can be actuated within the wellbore, isolating the zone. Pressure from a first direction can seat the first member 194 of each tool 100 against its shoulder 198, which can prevent flow in the first direction and pressure from a second direction can seat the second member 196 of each tool 100 against its shoulder 198, which can prevent flow in the second direction. The wellbore about the zone can be isolated in both directions. This can allow the zone to be pressure tested. After a pre-determined time, such as a sufficient amount of time to pressure test the zone, the second member 196 of each tool 100 can degrade and release, allowing fluid flow through each tool 100 in the second direction, i.e. toward the surface. Adjacent zones can be tested and produced in the same way using a series of tools 100 disposed within the wellbore. Furthermore, the tools 100 can be drilled more easily when the second member 196 is decomposed and unseated, because the differential pressure across the tool 100 is released.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A downhole tool, comprising:

an annular body having a valve assembly disposed therein, the valve assembly comprising:

a first member preventing flow in a first direction through the annular body;

a second member preventing flow in a second direction through the annular body, wherein the second member is free to move along at least a majority of a longitudinal extent of the annular body and comprises a degradable material that is temperature dependent, pressure dependent, or both temperature and pressure dependent; and a shoulder disposed on an inner diameter of the body between the first and second members, the shoulder having a first end contoured to sealingly engage an outer contour of the first member and a second end contoured to sealingly engage an outer contour of the second member; and an element system disposed about the annular body, wherein the element system is disposed beneath the shoulder, and the first and second members engage the first and second ends of the shoulder above the element system.

2. The tool of claim 1, further comprising a perforated member having a plurality of flow paths formed therethrough, the shoulder and the perforated member defining a housing for the second member within the annular body.

3. The tool of claim 2, wherein the perforated member comprises a plate having a plurality of axially-extending holes defined therein, wherein the axially-extending holes provide the plurality of flow paths.

4. The tool of claim 1, wherein the first and second members are spherical.

5. The tool of claim 1, wherein the first member is spherical and further comprises a degradable material that is temperature dependent, pressure dependent, or both temperature and pressure dependent.

6. The tool of claim 1, wherein the second member is spherical.

7. The tool of claim 1, further comprising a spring disposed within the annular body, wherein the first member is disposed between the spring and the first end of the shoulder, and the spring has a pre-determined compression.

8. The tool of claim 1, wherein the first member degrades at a first rate and the second member degrades at a second rate that is different from the first rate.

9. A downhole tool, comprising:

an annular body having a valve assembly disposed therein, the valve assembly comprising:

a first member comprising a degradable material that is temperature dependent, pressure dependent, or combinations thereof, wherein the first member prevents flow in a first direction through the annular body;

a second member comprising a degradable material that is temperature dependent, pressure dependent, or combinations thereof, wherein the second member prevents flow in a second direction through the annular body, and is free to move along at least a majority of a longitudinal extent of the annular body; and a shoulder disposed in an inner diameter of the body, wherein the shoulder comprises a first end for engaging the first member and a second end for engaging the second member;

an element system disposed about the annular body, wherein the element system is disposed beneath the shoulder and the first and second members engage the first and second ends of the shoulder above the element system; and first and second back-up rings disposed about the annular body, the first and second back-up rings each comprising two or more tapered wedges, wherein the tapered wedges are at least partially separated by two or more converging grooves.

10. The tool of claim 9, further comprising first and second slips disposed about the annular body, and beneath the first and second members.

11. The tool of claim 10, wherein the first slip is disposed adjacent the wedges of the first back-up ring, and the second slip is disposed adjacent the wedges of the second back-up ring.

12. The tool of claim 9, wherein the two or more converging grooves intersect one another.

13. The tool of claim 9, wherein the tapered wedges are adapted to extend circumferentially and radially engage an inner surface of a surrounding tubular or borehole.

14. The tool of claim 9, wherein at least one of the two converging grooves is disposed radially about the wedge and at least one of the two converging grooves is disposed circumferentially about the wedge.

15. The tool of claim 9, wherein the element system and the first and second back-up rings are constructed of a non-metallic material.

16. The tool of claim 9, further comprising a perforated member having a plurality of flow paths formed therethrough, the shoulder and the perforated member defining a housing for the second member within the annular body.

17. A method for producing hydrocarbon from a wellbore, comprising:

isolating the wellbore with a tool, the tool comprising:

an annular body having a valve assembly disposed therein;

a first degradable member preventing flow through the annular body;

a second degradable member preventing flow through the annular body, wherein the second degradable member is free to move along at least a majority of a longitudinal extent of the annular body;

a shoulder disposed on an inner diameter of the body between the members, the shoulder having a first end contoured to sealingly engage an outer contour of the first degradable member and a second end contoured to sealingly engage an outer contour of the second degradable member; and an element system disposed about the annular body, wherein the element system is disposed beneath the shoulder and the first and second members engage the first and second ends of the shoulder above the element system; and exposing the tool to a temperature, pressure, or combination thereof sufficient to decompose the first and second degradable members over a pre-determined period of time.

18. The method of claim 17, wherein the fluid flows through the tool uni-directionally.

19. The method of claim 17, further comprising pressure testing a hydrocarbon-bearing zone during the pre-determined period of time.

20. The method of claim 19, further comprising producing hydrocarbon from the tested zone through the tool.

21. A downhole tool, comprising:

an annular body having an upper end, a lower end, and a bore defined therein extending between the upper and lower ends;

a shoulder positioned in the bore and having a first end and a second end;

a first member disposed in the bore between the shoulder and the upper end, the first end of the shoulder being contoured to seal with an outer contour of the first member to block a downward flow of fluid in the bore, a second member disposed in the bore between the shoulder and the lower end, the second end of the shoulder being contoured to seal with an outer contour of the second member to block an upward flow of fluid in the bore, wherein the second member is free to move along at least a majority of a longitudinal extent of the annular body, and the first and second members each comprise a degradable material that is temperature dependent, pressure dependent, or both temperature and pressure dependent; and an element system disposed about the annular body, wherein the element system is disposed beneath the shoulder and the first and second members engage the first and second ends of the shoulder above the element system.

22. The tool of claim 21, further comprising a perforated member disposed proximal the lower end of the annular body, wherein the second member is maintained in the bore of the annular body by the perforated member and the second end of the shoulder.

23. The tool of claim 22, wherein the perforated member is a plate having a plurality of apertures defined therein.

24. The tool of claim 22, wherein the annular body defines a cavity between the perforated member and the shoulder to allow the second member to move freely therebetween.

25. The tool of claim 21, further comprising a spring positioned in the bore, above the shoulder, the spring being configured to bias the first member toward the first end of the shoulder.

26. The tool of claim 21, wherein the first and second members degrade at a different rate.

27. The tool of claim 21, wherein the first and second members degrade at the same rate.

28. The tool of claim 21, wherein the first member is configured to disengage from the first end of the shoulder to allow the upward flow of fluid and the second member is configured to disengage from the second end of the shoulder to allow the downward flow of fluid.

* * * * *